US007458370B2

(12) United States Patent
Chen

(10) Patent No.: US 7,458,370 B2
(45) Date of Patent: Dec. 2, 2008

(54) PAINTBALL FEEDING DEVICE OF A PAINTBALL MARKER GUN

(76) Inventor: Jian-Ming Chen, 6F, No. 544, Fongdong Rd., Fongshan City, Kaohsiung County (TW)

( * ) Notice: Subject to any disclaimer, the term of this patent is extended or adjusted under 35 U.S.C. 154(b) by 386 days.

(21) Appl. No.: 11/290,584

(22) Filed: Dec. 1, 2005

(65) Prior Publication Data

US 2008/0047536 A1 Feb. 28, 2008

(51) Int. Cl.
*F41B 11/02* (2006.01)

(52) U.S. Cl. ..... 124/51.1

(58) Field of Classification Search ..... 124/45, 124/51.1, 73, 74

See application file for complete search history.

(56) References Cited

U.S. PATENT DOCUMENTS 7,017,569 B2 * 3/2006 Jong ..... 124/52
2005/0274371 A1 * 12/2005 Lubben ..... 124/51.1
2006/0254572 A1 * 11/2006 Hall ..... 124/74
2007/0113834 A1 * 5/2007 Spicer ..... 124/49

* cited by examiner

*Primary Examiner*—John Ricci
(74) *Attorney, Agent, or Firm*—Rosenberg, Klein & Lee

(57) ABSTRACT

A feeding device of a paintball marker gun includes a signal transmitter, a signal receiver, and a paintball feeding unit containing paintballs; the signal transmitter is electrically connected to a controller held in the pistol grip; the paintball feeding unit is connected to the signal receiver, and it includes a stepping motor; when the trigger of the paintball marker gun is pressed to shoot a paintball, the signal transmitter will transmit a signal immediately, which will be received through the signal receiver such that the stepping motor of the paintball feeding unit will start rotating so as to feed a paintball to a main body of the paintball marker gun, thus making shooting and feeding of paintballs happen in a synchronized manner as well as preventing blockage and jams of paintballs.

2 Claims, 8 Drawing Sheets

PAINTBALL FEEDING DEVICE OF A PAINTBALL MARKER GUN

BACKGROUND OF THE INVENTION

1. Field of the Invention

The present invention relates to a paintball feeding device of a paintball marker gun, more particularly one, which will feed a paintball to the paintball marker gun as soon as a paintball is shot out, thus preventing blockage and jams of paintballs.

2. Brief Description of the Prior Art

In a major part of a survival game, the participants try to mark each other's bodies with paintballs, which are shot out from paintball marker guns. A participant will be considered out if his/her body is shot and marked with paints by paintballs. Such games are very exciting and getting more and more popular.

Various paintball marker guns are available to players in survival games. A conventional paintball marker gun structure includes a gun main body, a paintball feeding device connected to an uppermost side of the gun main body, and a high pressure gas tank connected to the gun main body; the paintball feeding device contains paintballs; when the trigger of the gun main body is pressed, the gas will make a paintball shot out from the gun main body. The paintball feeding device is equipped with a sensor, which is positioned in a space between a main body of the feeding device and the gun main body for detecting whether there is any paintball present in the space; a direct-current of the paintball feeding device will start rotating to feed paintballs to the gun main body if the sensor doesn't detect presence of any paintball in the space. However, blockage and jams of paintballs are prone to happen because paintball shooting and feeding aren't carried out in a synchronized manner, and the speed of paintball feeding isn't precisely controlled.

Another conventional paintball marker gun structure includes a gun main body, a sensor in the gun main body, and a paintball feeding device, which is connected to an upper side of the gun main body, and contains paintballs; when a paintball is shot out from the gun main body, a paintball will drop from the feeding device into the gun main body automatically owing to gravity; the sensor is used for detecting paintball shooting. Although paintballs can be automatically loaded with the help of gravity, the loading speed is relatively low. Consequently, the players can't have the pleasure of making continuous shots when using such paintball marker guns.

SUMMARY OF THE INVENTION

It is a main object of the invention to provide an improvement on a paintball feeding device of a paintball marker gun to overcome the above-mentioned problem. The paintball feeding device of the present invention includes a signal transmitter, a signal receiver, and a paintball feeding unit. The signal transmitter is electrically connected to a controller held in the pistol grip. The paintball feeding unit is connected to the signal receiver, and it includes a stepping motor. When the trigger of the paintball marker gun is pressed to shoot a paintball, the signal transmitter will transmit a signal immediately, which will be received through the signal receiver such that the stepping motor of the paintball feeding unit will start rotating so as to feed a paintball to a main body of the paintball marker gun, thus making shooting and feeding of paintballs happen in a synchronized manner, allowing the user to make continuous shots as well as preventing blockage and jams of paintballs.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
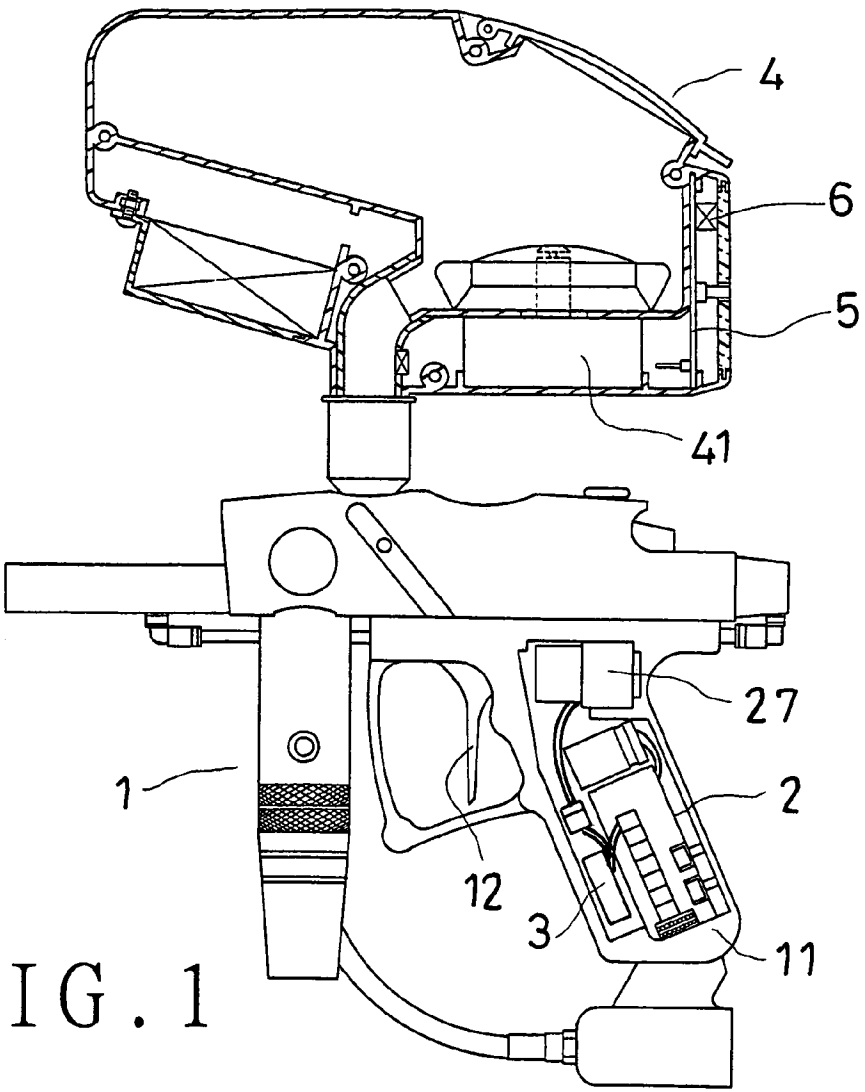
FIG. 1 is a side view of the paintball marker gun according to the present invention.
Figure 2:
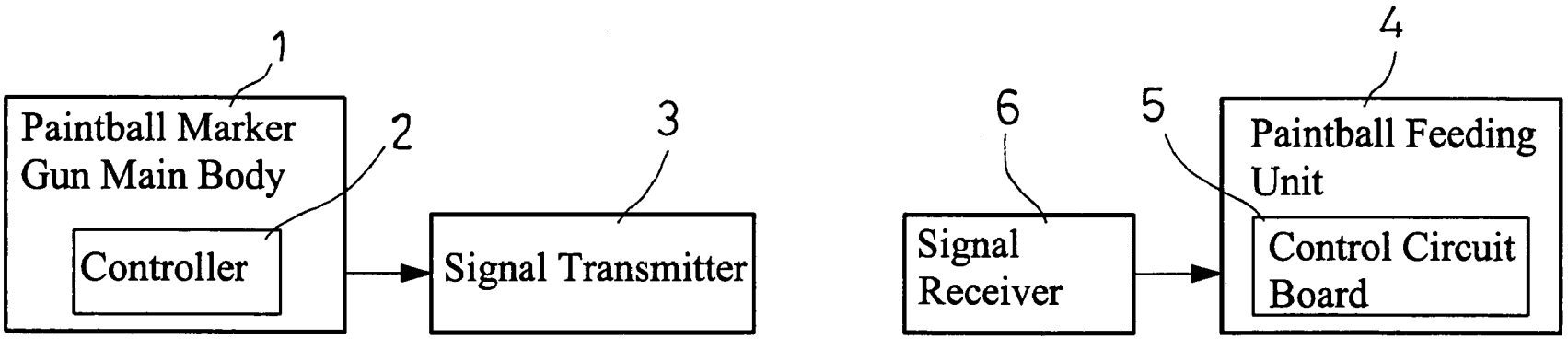
FIG. 2 is a block diagram of the present paintball marker gun.

Referring to FIGS. 1 and 2, a preferred embodiment of a paintball marker gun in the present invention includes a main body 1, and a paintball feeding device.

Figure 3:
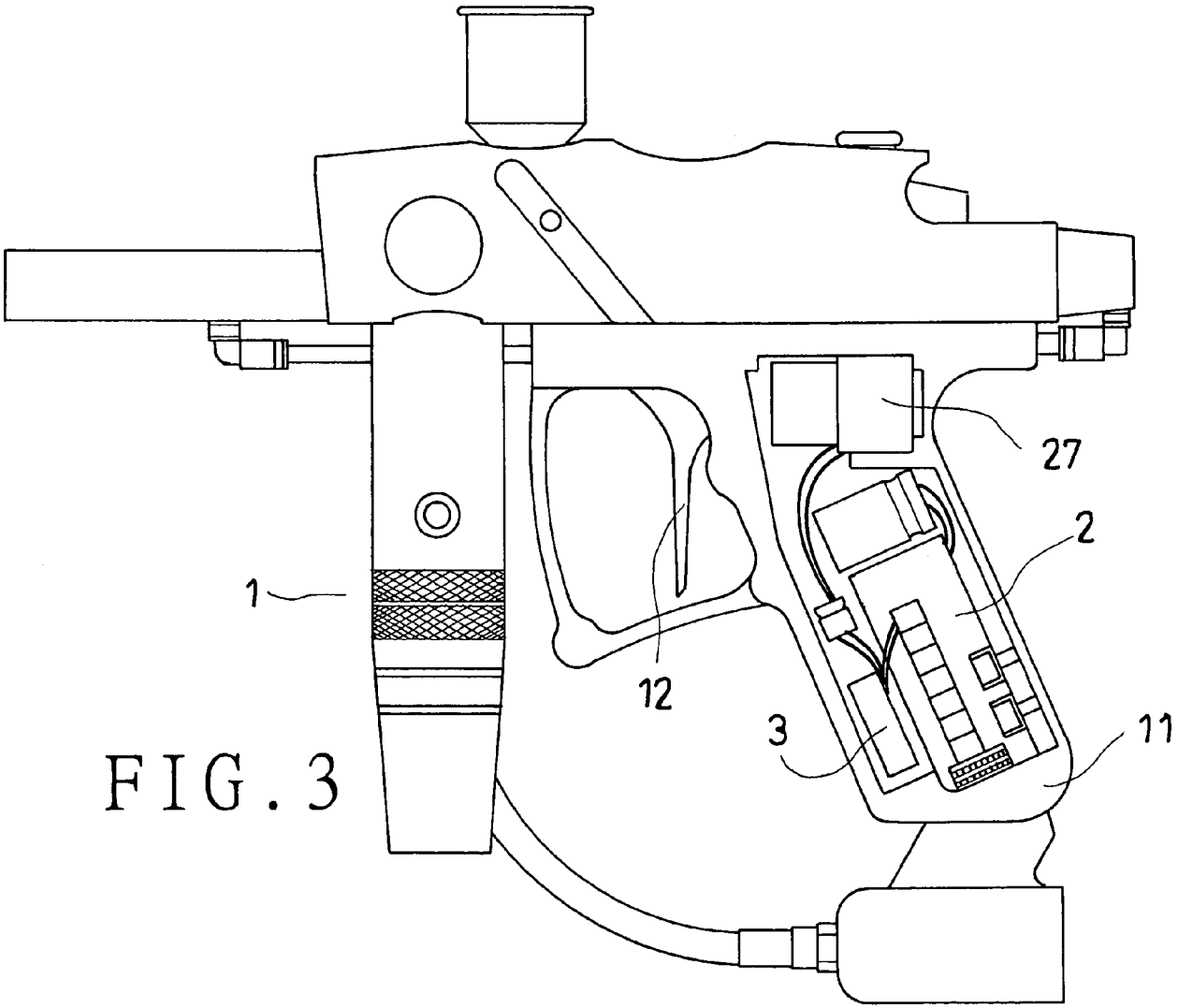
FIG. 3 is a partial side view of the present paintball marker gun.
Figure 4:
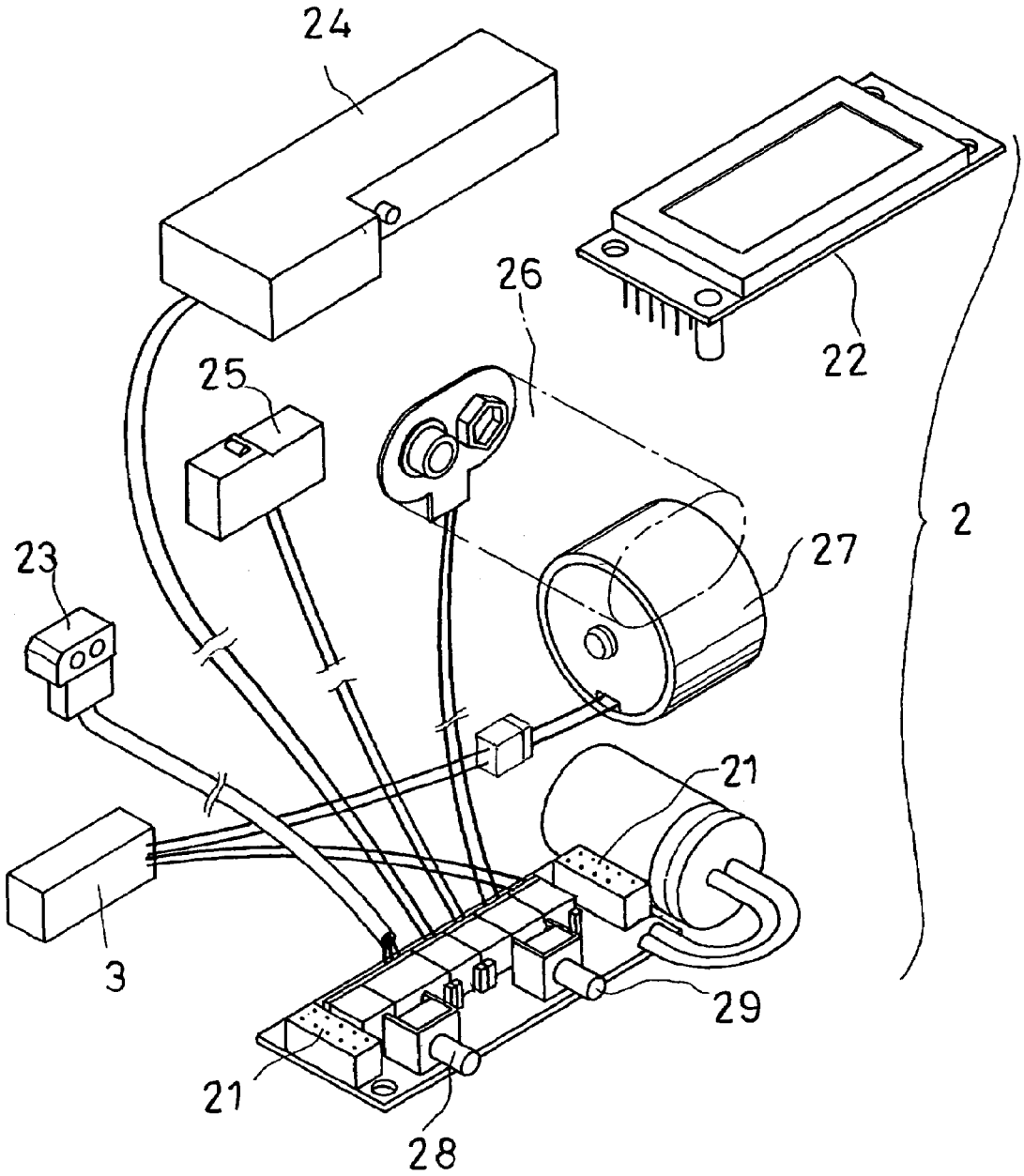
FIG. 4 is an exploded perspective view of the controller of the paintball marker gun in the present invention.
Figure 5:
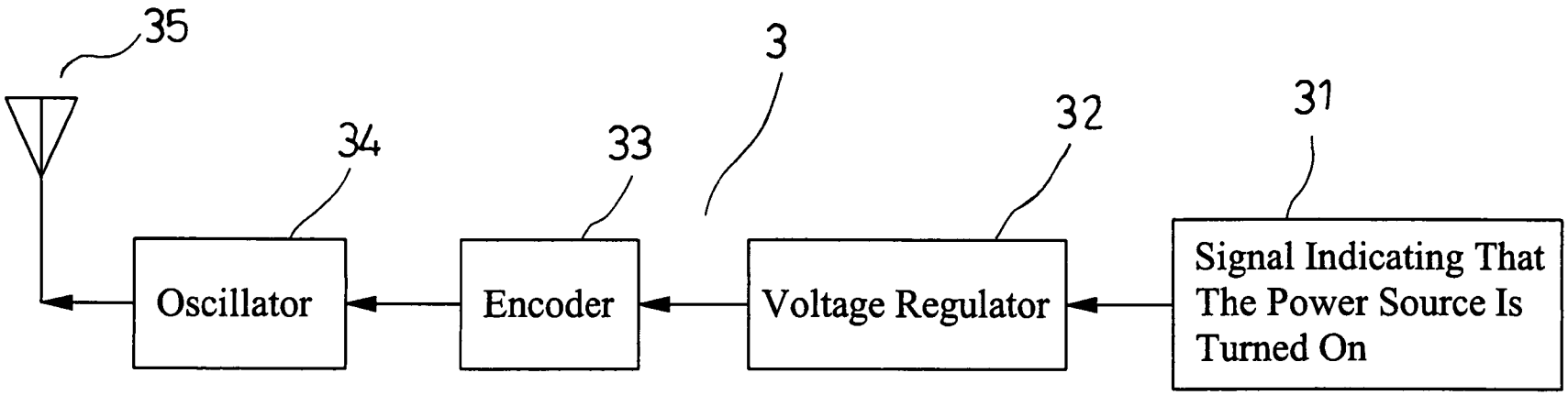
FIG. 5 is a circuit block diagram of the signal transmitter.

The main body 1 includes a pistol grip 11, a trigger 12, and a controller 2. Referring to FIGS. 3 to 5, the controller 2 is held in the pistol grip 11, and it includes a connecting port 21, an LCD circuit board 22 connected to the connecting port 21, a sensor 23, an electromagnetic valve 24, a microswitch 25, a battery 26, an electromagnet 27, a power source switch 28, a function choosing button 29; the sensor 23 is used for detecting whether paintballs have been moved to proper position; the electromagnetic valve 24 and the microswitch 25 will make paintballs shot when the trigger 12 is pressed to activate the microswitch 25; the electromagnet 27 and the power source switch 28 is used for turning on and off the power supplied from the battery 26 to the paintball marker gun; the function choosing button 29 is used for choosing among various functions of the paintball marker gun.

Figure 6:
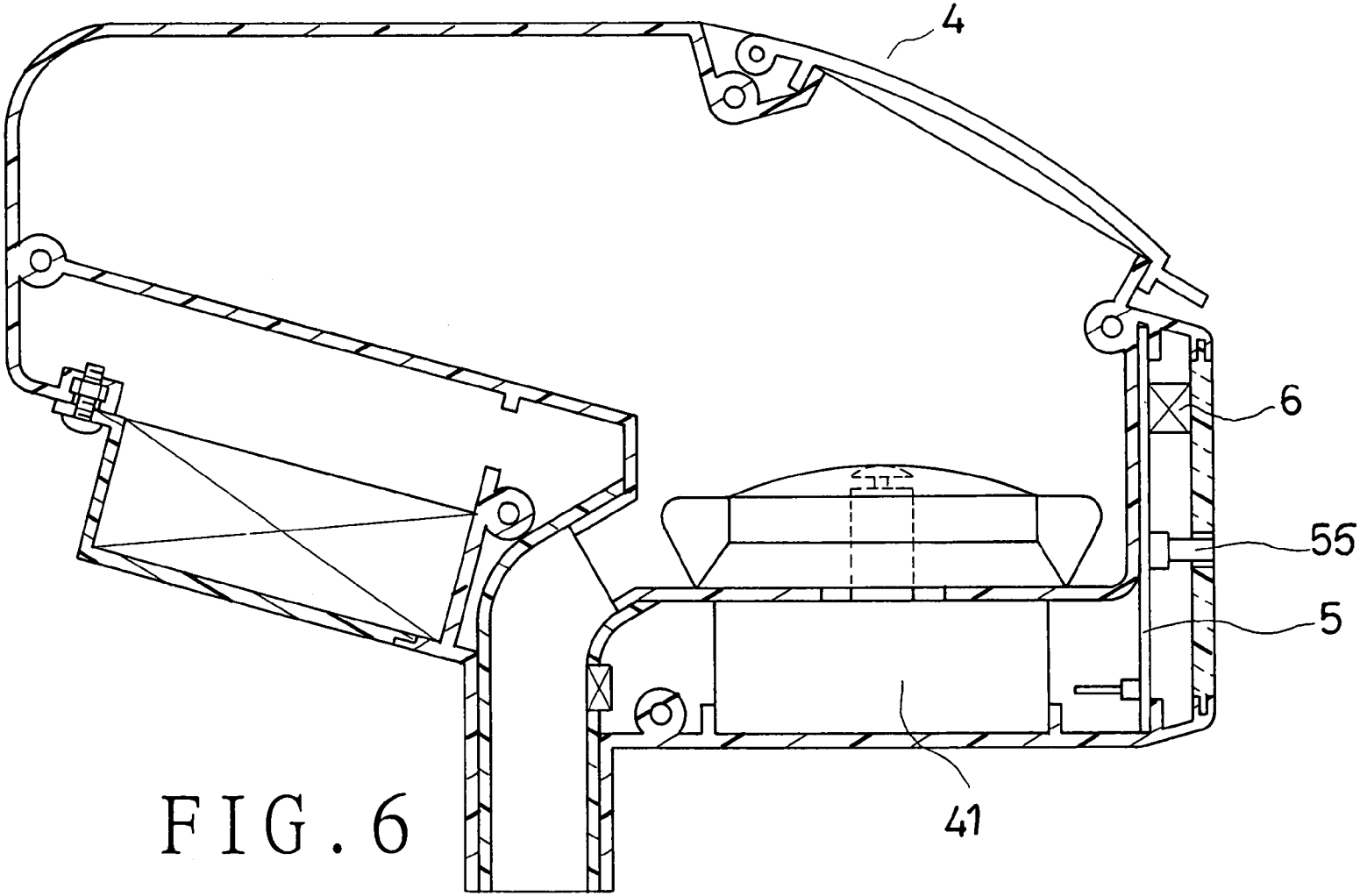
FIG. 6 is a view of the paintball feeding unit in the invention.
Figure 7:
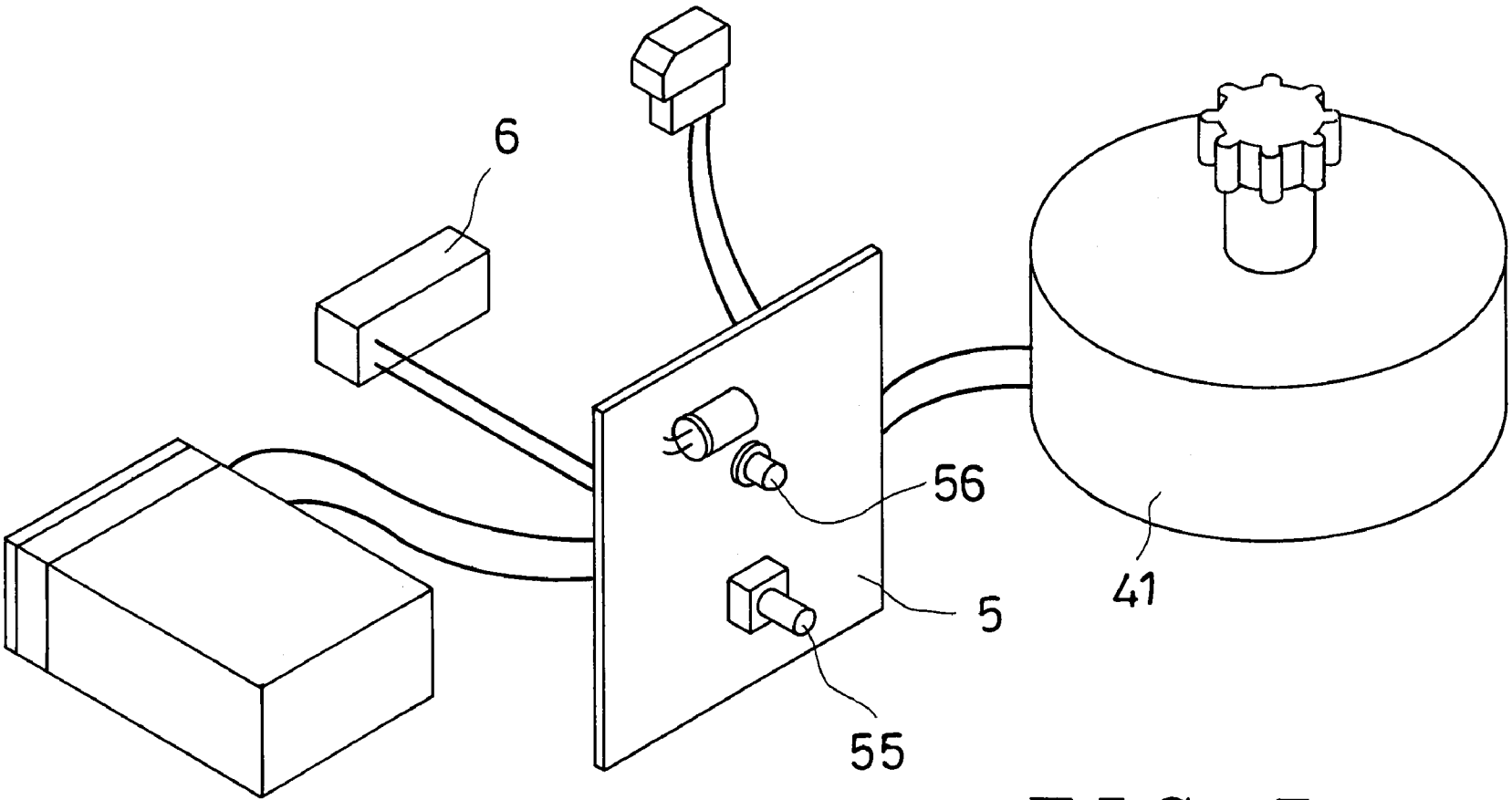
FIG. 7 is a view of the control circuit board in the invention.
Figure 8:
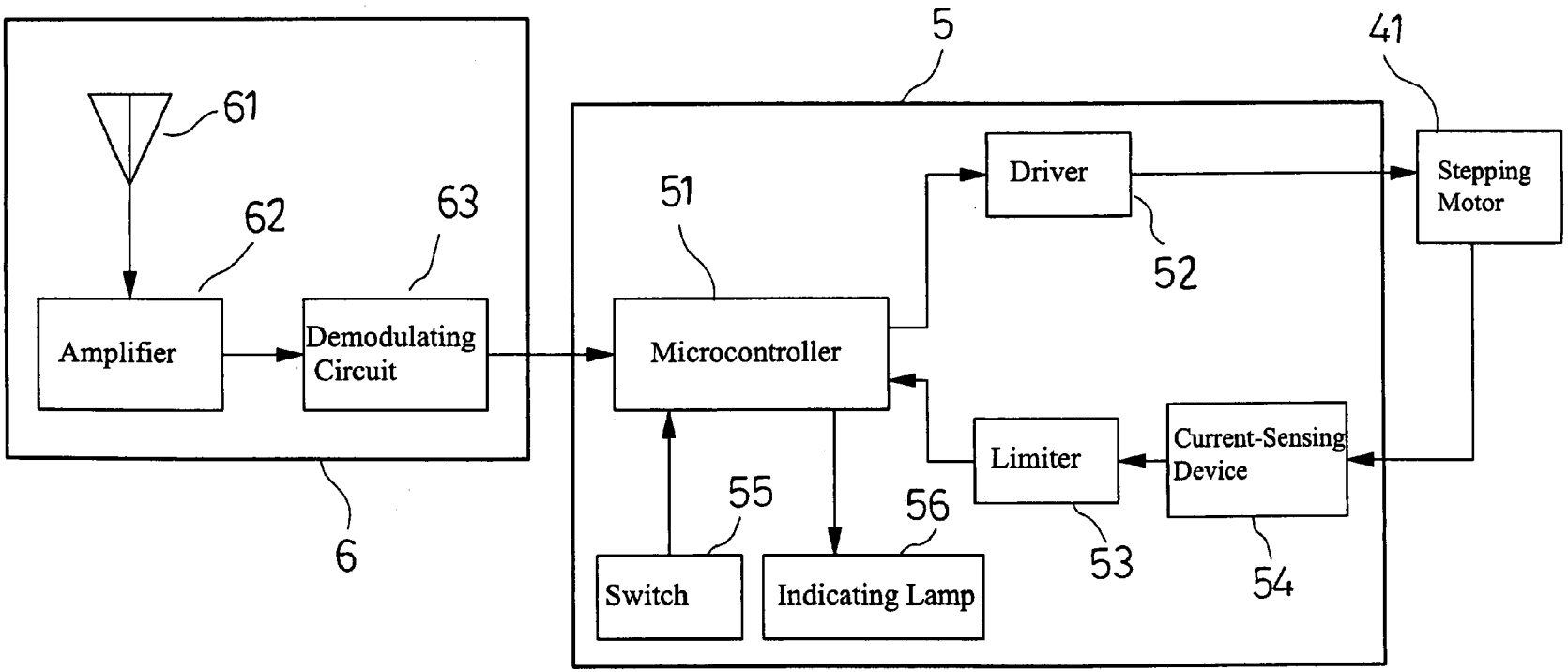
FIG. 8 is a circuit block diagram of the control circuit board and the signal receiving device in the present invention.

The paintball feeding device includes:

a signal transmitter 3; the signal transmitter 3 is held in the pistol grip 11, and electrically connected to the controller 2, and it includes a voltage regulator 32, a encoder 33, an oscillator 34, and an antenna 35; when the signal transmitter 3 receives a signal 31 indicating that the power source is turned on, the signal 31 will be voltage-regulated by means of the voltage regulator 32, encoded by means of the encoder 33, sent through the oscillator 34, and transmitted through the antenna 35; therefore, the signal transmitter 3 will be activated to transmit signals as soon as the trigger 12 is pressed to shoot a paintball;

a signal receiving device 6; the signal receiving device 6 includes an antenna 61, an amplifier 62, and a modulating circuit 63; and a paintball feeding unit 4 containing paintballs and joined to the main body 1 of the paintball marker gun; referring to FIGS. 6 to 8, the paintball feeding unit 4 is equipped with a control circuit board 5, and electrically connected to the signal receiver 6; the paintball feeding unit 4 is equipped with a stepping motor 41, or alternatively it can be equipped with a direct-current motor (not shown); there are a microcontroller 51 with decoding function, a driver 52, a restrictor 53, a current-sensing device 54, a switch 55, and an indicating lamp 56 fitted on the control circuit board 5; the driver 52 and the restrictor 53 are electrically connected to the microcontroller 51, and the current-sensing device 54 is connected to the restrictor 53; the stepping motor 41 is connected to both the driver 52 and the current-sensing device 54 on the control circuit board 5, and it is used to control the angle and speed of rotation so as to control the loop circuit in an optimal wireless and synchronized manner; furthermore, the microcontroller 51 is connected to both the switch 55 and the indicating lamp 56.

When a signal is received through the antenna 61 of the signal receiver 6, the signal will be amplified through the amplifier 62, and sent to the microcontroller 51 through the modulating circuit 63; the microcontroller 51 will learn the encoding of the encoder 33 of the signal transmitter 3 previously, and decode only according to the result of the learning, as shown in FIG. 5.

Therefore, when the trigger 12 is pressed to shoot a paintball, making the signal transmitter 3 activated to transmit signals, the signals will be received through the antenna 61 of the signal receiver 6, and decoded through the microcontroller 51; thus, the control circuit board 5 will make the stepping motor 41 of the paintball feeding unit 4 rotate so as to move and feed a paintball to the main body 1 of the paintball marker gun.

From the above description, it can be easily seen that with the paintball feeding device, the paintball marker gun of the present invention is free of the disadvantages of the conventional one, i.e. stock blockage and chopping of paintballs; the signal transmitter will transmit signals, and the signal receiver will receive the signals immediately after the trigger is pressed to shoot a paintball, thus making the stepping motor of the paintball feeding unit rotate so as to feed a paintball to the main body of the paintball marker gun at the same time. In other words, shooting and feeding of paintballs will happen in a synchronized manner. Therefore, the present paintball feeding device is convenient to use, capable of preventing blockage and jams of paintballs, and allowing the user to make continuous shots.

What is claimed is:

1. A paintball feeding device of a paintball marker gun, comprising (a) a signal transmitter held in a pistol grip of a main body of a paintball marker gun; the signal transmitter being electrically connected to a controller held in the pistol grip; the signal transmitter including:

a voltage regulator;

an encoder connected to the voltage regulator;

an oscillator connected to the encoder; and an antenna connected to the oscillator;

when the signal transmitter receives a signal indicating that power source is turned on, the signal being going to be voltage-regulated by means of the voltage regulator, encoded by means of the encoder, sent through the oscillator, and transmitted through the antenna;

(b) a signal receiver; the signal receiver including an antenna, an amplifier, and a demodulating circuit; and (c) a paintball feeding unit containing paintballs and joined to the main body of the paintball marker gun; the paintball feeding unit being electrically connected to the signal receiver; the paintball feeding unit including a control circuit board, and a stepping motor;

the control circuit board having a driver fitted thereon, which is electrically connected to the stepping motor;

the control circuit board having a limiter fitted thereon;

the control circuit board having a microcontroller fitted thereon, which has decoding function; both the driver and the limiter being connected to the microcontroller;

the control circuit board having a current-sensing device fitted thereon, which is electrically connected to both the limiter and the stepping motor;

when the trigger is pressed to shoot a paintball, the signal transmitter being going to transmit a signal immediately, which will be received through the antenna of the signal receiver, amplified through the amplifier, and sent to the microcontroller through the modulating circuit such that the stepping motor of the paintball feeding unit will start rotating so as to feed a paintball to the main body of the paintball marker gun, thus making shooting and feeding of paintballs happen in a synchronized manner.

2. A paintball feeding device of a paintball marker gun, comprising (a) a signal transmitter held in a pistol grip of a main body of a paintball marker gun; the signal transmitter being electrically connected to a controller held in the pistol grip; the signal transmitter including:

a voltage regulator;

an encoder connected to the voltage regulator;

an oscillator connected to the encoder; and an antenna connected to the oscillator;

when the signal transmitter receives a signal indicating that power source is turned on, the signal being going to be voltage-regulated by means of the voltage regulator, encoded by means of the encoder, sent through the oscillator, and transmitted through the antenna;

(b) a signal receiver; the signal receiver including an antenna, an amplifier, and a modulating circuit; and (c) a paintball feeding unit containing paintballs and joined to the main body of the paintball marker gun; the paintball feeding unit being electrically connected to the signal receiver; the paintball feeding unit including a control circuit board, and a direct-current motor;

the control circuit board having a driver fitted thereon, which is electrically connected to the direct-current motor;

the control circuit board having a limiter fitted thereon;

the control circuit board having a microcontroller fitted thereon, which has decoding function; both the driver and the limiter being connected to the microcontroller;

the control circuit board having a current-sensing device fitted thereon, which is electrically connected to both the limiter and the direct-current motor; when the trigger is pressed to shoot a paintball, the signal transmitter being going to transmit a signal immediately, which will be received through the antenna of the signal receiver, amplified through the amplifier, and sent to the microcontroller through the modulating circuit such that the direct-current motor of the paintball feeding unit will start rotating so as to feed a paintball to the main body of the paintball marker gun, thus making shooting and feeding of paintballs happen in a synchronized manner.

* * * * *